US009392376B2

(12) United States Patent
Khenkin et al.

(10) Patent No.: US 9,392,376 B2
(45) Date of Patent: Jul. 12, 2016

(54) MICROPHONE ON PRINTED CIRCUIT BOARD (PCB)

(71) Applicant: Invensense, Inc., San Jose, CA (US)

(72) Inventors: Aleksey S. Khenkin, Nashua, NH (US); Anthony D. Minervini, Palos Hills, IL (US)

(73) Assignee: INVENSENSE, INC., San Jose, CA (US)

( * ) Notice: Subject to any disclaimer, the term of this patent is extended or adjusted under 35 U.S.C. 154(b) by 228 days.

(21) Appl. No.: 14/089,649

(22) Filed: Nov. 25, 2013

(65) Prior Publication Data

US 2015/0146887 A1 May 28, 2015

(51) Int. Cl.
*H04R 3/00* (2006.01)
*H04R 19/04* (2006.01)

(52) U.S. Cl.
CPC ..... *H04R 19/04* (2013.01)

(58) Field of Classification Search
CPC ..... H04R 17/00; H04R 17/02; H04R 3/00; H04R 19/04; H04R 2201/003; H04R 2499/11; H04R 1/406; H04R 1/04
USPC ..... 381/114
See application file for complete search history.

(56) References Cited

U.S. PATENT DOCUMENTS

2013/0161702 A1* 6/2013 Chen ..... B81C 1/00246 257/254

* cited by examiner

*Primary Examiner* — Paul S Kim
(74) *Attorney, Agent, or Firm* — Maryam Imam; IPxLaw Group LLP

(57) ABSTRACT

A MEMS device includes a MEM-CMOS module having a CMOS chip and a MEMS chip. The MEMS chip includes a port exposed to the environment. The MEMS device further includes a printed circuit board (PCB) with an aperture, wherein the MEMS-CMOS module is directly mounted on the PCB.

28 Claims, 4 Drawing Sheets

MICROPHONE ON PRINTED CIRCUIT BOARD (PCB)

BACKGROUND

Various embodiments of the invention relate generally to a MEMS device and particularly to a MEMS device on a printed circuit board (PCB).

As form factors grow smaller with time, so do MEMS devices. The height of MEMS devices, particularly those used as microphones includes not only MEMS and CMOS heights but also the height of a laminate on top of which the MEMS and CMOS chip are built. The laminate is typically 0.25 millimeters (mm), adding to the overall height of the microphone. While this measurement may seem insubstantial, with the size of the microphone being in the order of millimeters, the laminate-associated height increase is indeed substantial.

Also added to the overall height of the microphone is solder which is used to physically connect the laminate to a flexible printed circuit board (PCB). More importantly, due to the presence of a port in the PCB, in microphone applications the solder adds undesirable contamination.

Further, added steps are necessary in building the microphone, often requiring each step to be performed by a different manufacturer. For example, a manufacturer may build the MEMS chip, the CMOS chip, and the laminate, and provide the same as one module to another manufacturer. The second manufacturer can then mount the module onto a PCB, along with forming passive elements on the PCB. Additional steps during manufacturing are inherently undesirable.

Thus, height, contamination and extra manufacturing step(s) are currently experienced limitations in building a MEMS device, such as a microphone.

What is needed is a MEMS device with improved form factor, reduced contamination, and ease of manufacturing.

SUMMARY

Briefly, an embodiment of the invention includes a MEMS device having a MEMS-CMOS module with a CMOS chip and a MEMS chip. The MEMS chip includes a port exposed to the environment. The MEMS device further includes a printed circuit board (PCB) with an aperture, wherein the MEMS-CMOS module is directly mounted on the PCB.

A further understanding of the nature and the advantages of particular embodiments disclosed herein may be realized by reference of the remaining portions of the specification and the attached drawings.

DETAILED DESCRIPTION OF EMBODIMENTS

The following description describes a MEMS device. The MEMS device has a MEMS-CMOS module that is directly mounted on a printed circuit board (PCB), as discussed below.

In the described embodiments Micro-Electro-Mechanical Systems (MEMS) refers to a class of structures or devices fabricated using semiconductor-like processes and exhibiting mechanical characteristics such as the ability to move or deform. MEMS often, but not always, interact with electrical signals. MEMS devices include but are not limited to gyroscopes, accelerometers, magnetometers, pressure sensors, microphones, and radio-frequency components. Silicon wafers containing MEMS structures are referred to as MEMS wafers.

In the described embodiments, MEMS device may refer to a semiconductor device implemented as a micro-electro-mechanical system. MEMS structure may refer to any feature that may be part of a larger MEMS device.

In the described embodiments, a chip includes at least one substrate typically formed from a semiconductor material. A single chip may be formed from multiple substrates, where the substrates are mechanically bonded to preserve the functionality. Multiple chip includes at least 2 substrates, wherein the 2 substrates are electrically connected, but do not require mechanical bonding. Integrated Circuit (IC) chip may refer to a silicon substrate with electrical circuits, typically CMOS circuits Particular embodiments and methods of the invention disclose a MEMS device having a MEMS-CMOS module with a CMOS chip and a MEMS chip. The MEMS chip includes a port exposed to the environment. The MEMS device further includes a printed circuit board (PCB) with an aperture, wherein the MEMS-CMOS module is directly mounted on the PCB.

Figure 1:
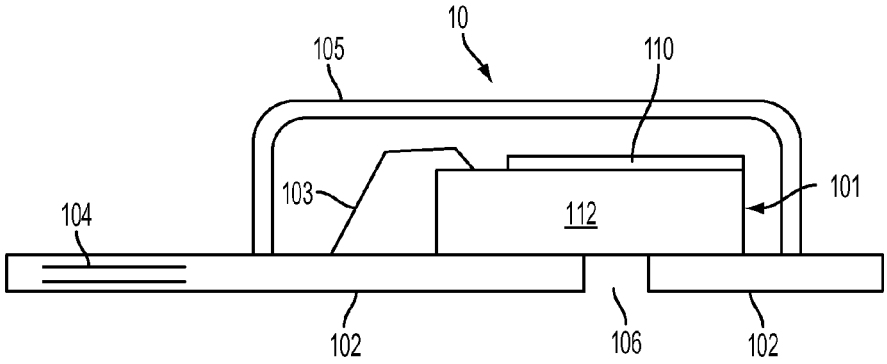
FIGS. 1-4 show MEMS devices, in accordance with various embodiments of the invention.

Referring now to FIG. 1, a MEMS device 10 is shown, in accordance with an embodiment of the invention. The MEMS device 10 is shown to include a MEMS-CMOS module 101, a printed circuit board (PCB) 102, passive elements 104, a port 106, a wirebond 103, and a lid 105. The MEMS-CMOS module 101 is shown to include a CMOS chip 112 and a MEMS chip 110 chip, and is placed on the PCB 102.

In the embodiment of FIG. 1, the MEMS chip 110 is shown placed on top of the CMOS chip 112, though in other embodiments the CMOS chip 112 may be placed on top of the MEMS chip 110 with the wirebond 103 electrically and physically connecting the CMOS substrate 112 to the PCB 102. In other embodiments, the CMOS chip and the MEMS chip are stacked on top of each other, with potentially more than one type of chip. For example, the stack may include a CMOS chip, on top of which is a MEMS chip, on top of which is another CMOS chip. In other embodiments, the CMOS chip 112 and the MEMS chip 110 may be positioned next to each other rather than on top of each other, as will be further discussed and shown.

The MEMS-CMOS module 101 is shown mounted directly on the PCB 102. A port 106 is formed under the MEMS-CMOS module 101 in the PCB 102, exposing the module 101 to the environment. In this embodiment of the invention, the MEMS device 10 is a microphone. In other embodiments of the invention, the MEMS device 10 is a humidity sensor, a pressure sensor or other contemplated sensors.

In FIG. 1, the CMOS-MEMS module 101 is physically and electrically connected to the PCB 102 via at least one wirebond 103.

The lid 105 is attached to the PCB 102 and in applications where the MEMS device 10 is a microphone, lid 105 acoustically seals the back of the microphone and forms an acoustic cavity necessary for microphone operation, as is known to those skilled in the art. The lid 105 further physically protects the components of the MEMS device 10. The lid may be made of at least one electrically conductive layer or non-conductive layer. A conductive lid is used to shield the MEMS device against radio frequency (RF) interference. In some embodiments of the invention, no lid may be used, and its functions may be performed by other components.

In an embodiment of the invention, PCB 102 is a flexible PCB. In some embodiments of the invention, the PCB 102 is rigid. Optionally, the PCB 102 includes at least one passive element 104. The passive elements 104 may include, for example, capacitors or resistors, and may be formed as layers within PCB 102 by methods commonly known to those skilled in the art. Optionally, the passive elements 104 are embedded in the PCB 302, as in the embodiments of FIGS. 1 and 2.

In some embodiments of the invention, rather than wire bonding, the MEMS device 10 uses flip chip packaging, in which case the MEMS-CMOS module 101 is flipped with the MEMS chip 110 being on the bottom and the CMOS chip 112 be on top. The CMOS chip 112 is connected to the PCB 102 using stud bumps.

The MEMS-CMOS module 101 is mounted directly onto the PCB 102 thereby eliminating the need for a laminate or solder due to the lack of soldering, little to no contamination is experienced by the MEMS device 10. Additionally, the extra step of connecting the laminate and the CMOS and MEMS chips to the PCB is eliminated.

Figure 2:
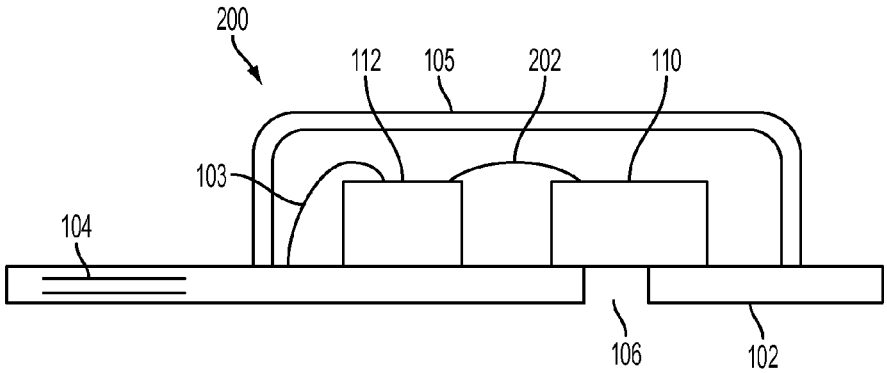

FIG. 2 shows a MEMS device 200, in accordance with another embodiment of the invention. In the embodiment of FIG. 2, the MEMS chip 110 and the CMOS chip 112 are positioned next to each other and directly on top of the PCB 102, with the MEMS chip 110 being positioned on top of the port 106 of the PCB 102. The MEMS chip 110 and the CMOS chip 112 are both directly mounted onto the PCB 102. The MEMS chip 110 is shown physically and electrically connected to the CMOS chip 112 through the wirebond 202 and the CMOS chip 112 is shown electrically connected to the PCB 102 through the wirebond 103.

Figure 3A:
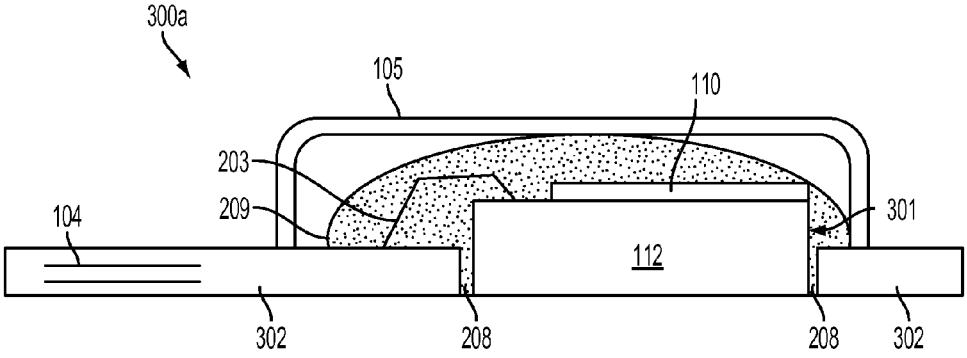

FIG. 3*a* shows a MEMS device 300*a*, in accordance with yet another embodiment of the invention. In FIG. 3*a*, the MEMS-CMOS module 301 is located inside the aperture 208 in the PCB 302. The aperture 208 is at least as large as required to fit the MEMS-CMOS module 301 within. The bottom surface of the MEMS-CMOS module 301 is aligned with the bottom surface of the PCB 302 so that the two surfaces are essentially coplanar. The MEMS-CMOS module 301 is attached to the PCB 302 using conformal coating 209. The conformal coating 209 covers the sides of the MEMS-CMOS substrate 301 and at least some portion of the top surface of the PCB 302. In other embodiments, the conformal coating 209 may also cover at least a portion the top of the MEMS-CMOS module 301. In yet another embodiment, MEMS and CMOS chips are separately placed, with only the CMOS chip located inside the aperture 208 and attached using conformal coating 209.

Figure 3B:
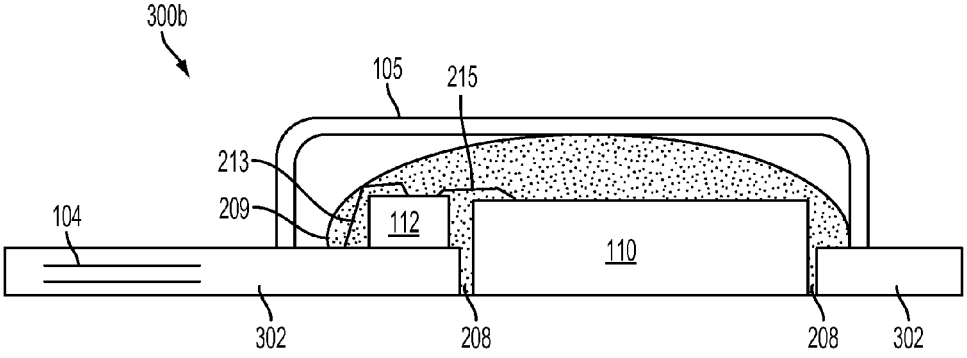

FIG. 3*b* shows a MEMS device 300*b*, in accordance with yet another embodiment of the invention. In FIG. 3*b*, the MEMS chip 110 is located inside the aperture 208. The CMOS chip 112 is located on the PCB 302. The MEMS chip 110 and the CMOS chip 112 are connected by wire bond 215. The CMOS chip is connected to PCB 302 by wirebond 213.

In an embodiment of the invention, the conformal coating 209 has a Young's modulus of elasticity that is less than that of either the Young's modulus of the MEMS-CMOS module 301 or the Young's modulus of the PCB 302. As an example, the conformal coating 209 may be made of silicone, such as Room Temperature Vulcanizing (RTV) silicone rubber compound, such as Dow 7920.

Optionally, the lid 105 fully covers the conformal coating 209 and is physically attached to the PCB 302 around the perimeter. The volume of the conformal coating 209 may be less than that of the back cavity of the microphone formed under the lid 105, in applications where the MEMS device 300*a* is a microphone. During manufacturing, the conformal coating 209 is initially in a substantially liquid state and deposited around the module 301 to form a complete acoustic seal between the PCB 302 and the module. Upon curing, the conformal coating 209 takes on a substantially solid state.

During manufacturing, the PCB 302 and the MEMS-CMOS module 301 are held in place using tape, and once the conformal coating 209 is applied and cured, the tape may be removed. The tape holds the MEM-CMOS module 301 in place until the conformal coating 209 is cured.

Figure 4:
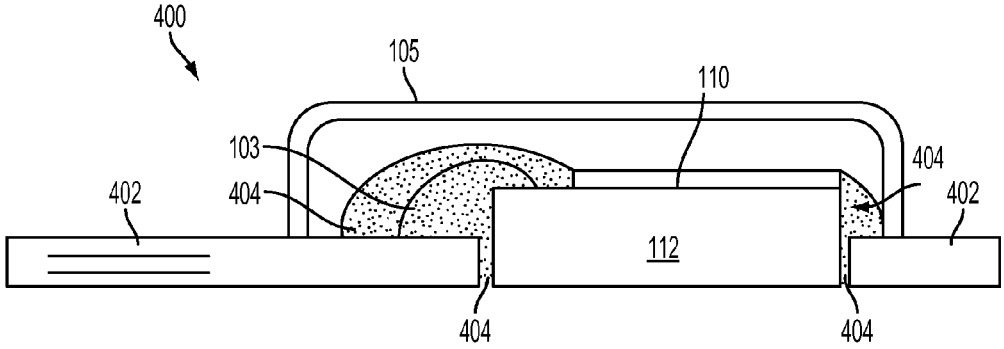

FIG. 4 shows a MEMS device 400, in accordance with another embodiment of the invention. The MEMS device 400 is analogous to the MEMS device 300*a* except that the conformal coating 404, of the MEMS device 400, covers the sides of the MEMS-CMOS module and not its top. The conformal coating 404 also covers the PCB 402 in areas adjacent to the MEMS-CMOS module 101, as does the conformal coating 309 of FIG. 3*a*.

Figure 5:
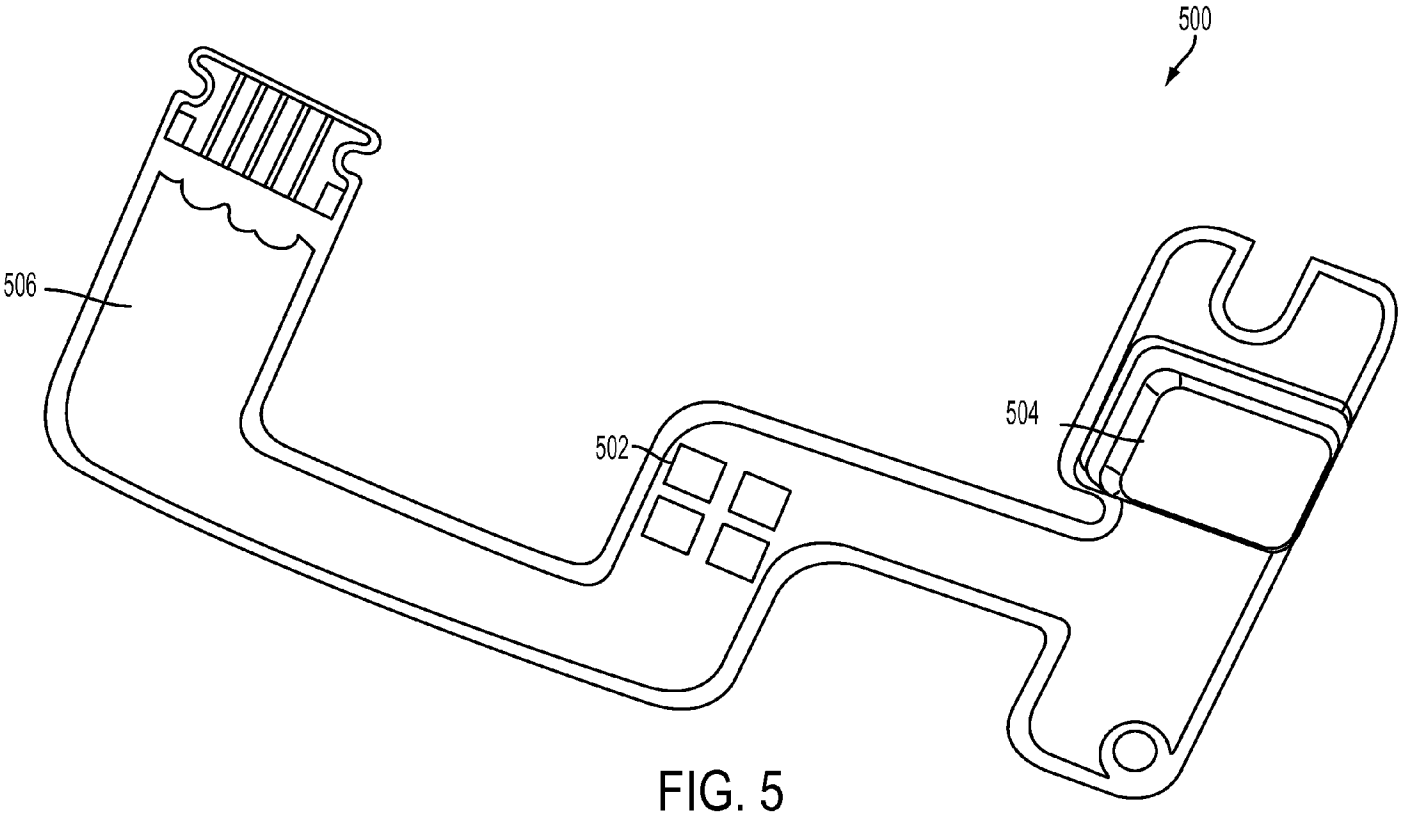
FIG. 5 shows a picture of the PCB with test points employed in the various embodiments of the MEMS device.

FIG. 5 shows a testing assembly 500. In an embodiment, testing assembly 500 includes PCB 506 with test points 502 and a chip 504. Chip 504 can be any MEMS device. In an embodiment, chip 504 can be any of the MEMS devices 10, 200, 300*a*, 300*b* or 400. The test points 502 are connected to chip 504. The test points 502 are dedicated test points and may be located on either the bottom or the top surface of the PCB 506. Test points 502 aid in the testing of the assembly 500 with MEMS device 10 or any of the other MEMS devices of the various embodiments of the invention.

Although the description herein has been written with respect to particular embodiments thereof, these particular embodiments are merely illustrative, and not restrictive.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features, without departing from the scope and spirit as set forth. Therefore, many modifications may be made to adapt a particular situation or material to the essential scope and spirit.

What we claim is:

1. A MEMS device comprising:

a MEMS-CMOS module including a CMOS chip and a MEMS chip, wherein the MEMS chip includes a port exposed to the environment; and a printed circuit board (PCB) having an aperture, at least one of the MEMS and CMOS chips of the MEMS-CMOS module disposed on the PCB and aperture or within the aperture of the PCB, wherein at least one of the MEMS and CMOS chips of the MEMS-CMOS module being directly mounted on top of the PCB or within the aperture of the PCB, further wherein an intermediate layer is absent between the MEMS chip or the CMOS chip and the top of the PCB in the case where the MEMS chip or the CMOS chip is directly mounted to the PCB.

2. The MEMS device of claim 1, wherein the CMOS chip and the MEMS chip are positioned side-by-side and such that the CMOS chip is directly mounted to the PCB and the MEMS chip is directly mounted to the PCB.

3. The MEMS device of claim 2, wherein the CMOS chip is electrically connected to the MEMS chip and the CMOS chip is electrically connected to the PCB.

4. The MEMS device of claim 1, wherein the CMOS chip and the MEMS chip are stacked on top of each other.

5. The MEMS device of claim 4, wherein the MEMS chip is positioned on top of the CMOS chip and the CMOS chip is electrically connected to the PCB.

6. The MEMS device of claim 4, wherein the CMOS chip is positioned over the MEMS chip and the CMOS chip is electrically connected to the PCB.

7. The MEMS device of claim 1, wherein the PCB is flexible.

8. The MEMS device of claim 1, wherein the PCB is rigid.

9. The MEMS device of claim 1, wherein the PCB includes at least one passive element.

10. The MEMS device of claim 9, wherein the at least one passive element is included in the PCB as at least one layer.

11. The MEMS device of claim 1, wherein the aperture of the PCB and the port of the MEMS chip are substantially aligned.

12. The MEMS device of claim 1, further including a conformal coating disposed on at least one side of the MEMS-CMOS module and the PCB.

13. The MEMS device of claim 12, wherein the conformal coating is additionally disposed on top of the MEMS-CMOS module.

14. The MEMS device of claim 1, further including a lid physically attached to the PCB and covering the conformal coating.

15. The MEMS device of claim 14, wherein the conformal coating has associated therewith a Young's modulus and the MEMS-CMOS module has associated therewith a Young's modulus and the PCB has associated therewith a Young's modulus, wherein the Young's modulus of the conformal coating is less than that of either the MEMS-CMOS module or the PCB.

16. The MEMS device of claim 1, further including a lid covering and enclosing the MEMS-CMOS module, the lid being physically attached to the PCB.

17. The MEMS device of claim 16, wherein the lid is electrically conductive.

18. The MEMS device of claim 16, wherein the lid is electrically nonconductive.

19. The MEMS device of claim 16, wherein he lid comprises at least one electrically conductive layer.

20. The MEMS device of claim 16, wherein the lid provides an acoustic seal.

21. The MEMS device of claim 16, wherein the lid provides a back cavity for a microphone.

22. The MEMS device of claim 1, wherein the MEMS-CMOS module is located within an aperture in the PCB.

23. The MEMS device of claim 1, wherein the MEMS-CMOS module has a bottom surface that is substantially aligned with a bottom surface of the PCB such that the two bottom surfaces are substantially coplanar.

24. The MEMS device of claim 1, wherein the PCB has electrical test points on one or more surfaces thereof.

25. The MEMS device of claim 1, wherein the MEMS-CMOS module is mounted and electrically connected to the PCB via flip-chip (CSP) technology.

26. The MEMS device of claim 1, wherein the MEMS device is one of a microphone, humidity sensor, or a pressure sensor.

27. A method of fabricating a MEMS device comprising:

forming a MEM-CMOS module with a MEMS chip disposed on top of a CMOS chip, the MEMS chip includes a port exposed to the environment;

mounting the MEMS-CMOS module directly on top of a printed circuit board (PCB) having an aperture or within the aperture of the PCB, at least one of the MEMS and CMOS chips of the MEMS-CMOS module disposed on the PCB and aperture or within the aperture of the PCB;

in the case where the MEMS chip or the CMOS chip is directly mounted to the PCB, avoiding an intermediate layer disposed between the MEMS chip or the CMOS chip and the top of the PCB; and electrically connecting the MEMS-CMOS module to the PCB.

28. A method of fabricating a MEMS device comprising:

mounting a MEM-CMOS module with a CMOS chip directly on top of a printed circuit board (PCB) having an aperture or within the aperture of the PCB the CMOS chip being disposed on the PCB and aperture or within the aperture of the PCB;

mounting a MEMS chip directly on top of the PCB or within the aperture of the PCB, the CMOS substrate being disposed on the PCB and aperture or within the aperture of the PCB;

in the case where the MEMS chip or the CMOS chip is directly mounted to the PCB, avoiding an intermediate layer disposed between the MEMS chip or the CMOS chip and the top of the PCB;

electrically connecting the CMOS chip to the MEMS chip; and electrically connecting the CMOS chip to the PCB.

* * * * *